US009845664B2

(12) United States Patent
Nield

(10) Patent No.: US 9,845,664 B2
(45) Date of Patent: Dec. 19, 2017

(54) SYSTEM AND METHOD FOR COMMUNICATING WITH A DRILL RIG

(71) Applicant: Barry Nield, Greenville, SC (US)

(72) Inventor: Barry Nield, Greenville, SC (US)

(73) Assignee: Barry Nield, Greenville, SC (US)

( * ) Notice: Subject to any disclaimer, the term of this patent is extended or adjusted under 35 U.S.C. 154(b) by 1006 days.

(21) Appl. No.: 13/872,208

(22) Filed: Apr. 29, 2013

(65) Prior Publication Data

US 2014/0318864 A1 Oct. 30, 2014

(51) Int. Cl.
*E21B 41/00* (2006.01)

(52) U.S. Cl.
CPC ..... *E21B 41/00* (2013.01)

(58) Field of Classification Search
CPC ..... E21B 44/00; E21B 41/00; E21B 47/12; E21B 47/124; E21B 15/003; G01V 11/002
USPC ..... 703/10; 702/3
See application file for complete search history.

(56) References Cited

U.S. PATENT DOCUMENTS 6,079,490 A 6/2000 Newman et al.
7,006,920 B2 2/2006 Newman et al.
7,366,614 B2 * 4/2008 Roy ..... G01W 1/00 702/3
7,453,768 B2 * 11/2008 Hall ..... G01V 1/40 340/853.1
7,571,817 B2 * 8/2009 Scott ..... B01D 33/0376 209/404
8,172,740 B2 * 5/2012 El Dorry ..... B04B 1/2016 494/10
8,360,171 B2 * 1/2013 Boone ..... E21B 7/068 175/26
2005/0115706 A1 6/2005 Cole
2009/0105059 A1 * 4/2009 Dorry ..... B04B 1/2016 494/37
2012/0222852 A1 * 9/2012 Pelletier ..... E21B 49/10 166/53
2013/0076525 A1 * 3/2013 Vu ..... E21B 41/00 340/853.1
2013/0176137 A1 7/2013 Kolpack
2013/0186687 A1 7/2013 Snyder
2015/0160101 A1 * 6/2015 Gao ..... G01M 13/028 702/6
2015/0233197 A1 8/2015 Oy
2016/0203681 A1 7/2016 Nield

* cited by examiner

*Primary Examiner* — Michael Wills, III
(74) *Attorney, Agent, or Firm* — Dority & Manning, P.A.

(57) ABSTRACT

A system for communicating with a drill rig includes a data acquisition board on the drill rig. A plurality of sensors are on the drill rig, and each sensor transmits data associated with the drill rig to the data acquisition board. A processor on the data acquisition board is configured to execute first logic stored in a first memory that causes the processor to format the data, store the data, and transfer the data to a mobile communications device. A method for communicating with a drill rig includes sensing an operating parameter on the drill rig and transmitting data reflective of the operating parameter to a data acquisition board on the drill rig. The method further includes formatting the data with the data acquisition board and transferring the formatted data from the data acquisition board to a mobile communications device.

17 Claims, 4 Drawing Sheets

SYSTEM AND METHOD FOR COMMUNICATING WITH A DRILL RIG

FIELD OF THE INVENTION

The present invention generally involves a system and method for communicating with a drill rig. In particular embodiments, the system and method may be incorporated into land-based or offshore drill rigs used for gas production and/or well service operation.

BACKGROUND OF THE INVENTION

Drill rigs are commonly used in oil and gas production and well service operations and include heavy duty machinery to bore substantial distances below the earth's surface. The drill rigs are often located in remote locations, and the heavy duty machinery is expensive to maintain and can cause significant personnel and equipment damage in a short period of time. In addition, changes in environmental conditions and/or the location of the drill rig may adversely affect operations and maintenance of the heavy duty machinery. As a result, local personnel are often required to monitor the operations, identify operating trends and/or imminent events, and take appropriate actions to prevent or mitigate personnel and/or equipment damage.

In some cases, remote monitoring of the drill rig may supplement the knowledge, training, resources, and/or experience of the local personnel to enhance the safe and efficient operation of the heavy duty equipment. For example, remote monitoring may enable more accurate and sophisticated analysis of operating parameters to improve trend analysis, facilitate maintenance scheduling, and/or anticipate imminent equipment failures or unsafe operating practices. As a result, an improved system and method for communicating with drill rigs would be useful.

BRIEF DESCRIPTION OF THE INVENTION

Aspects and advantages of the invention are set forth below in the following description, or may be obvious from the description, or may be learned through practice of the invention.

One embodiment of the present invention is a system for communicating with a drill rig that includes a data acquisition board on the drill rig. A plurality of sensors are on the drill rig, and each sensor transmits data associated with the drill rig to the data acquisition board. A processor on the data acquisition board is configured to execute first logic stored in a first memory that causes the processor to format the data, store the data, and transfer the data to a mobile communications device.

Another embodiment of the present invention is a method for communicating with a drill rig that includes sensing an operating parameter on the drill rig and transmitting data reflective of the operating parameter to a data acquisition board on the drill rig. The method further includes formatting the data with the data acquisition board and transferring the formatted data from the data acquisition board to a mobile communications device.

In yet another embodiment of the present invention, a method for communicating with a drill rig includes sensing an operating parameter on the drill rig and transmitting data reflective of the operating parameter to a data acquisition board on the drill rig. The method further includes formatting the data with the data acquisition board and transferring the formatted data from said data acquisition board to a database server remote from the drill rig.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
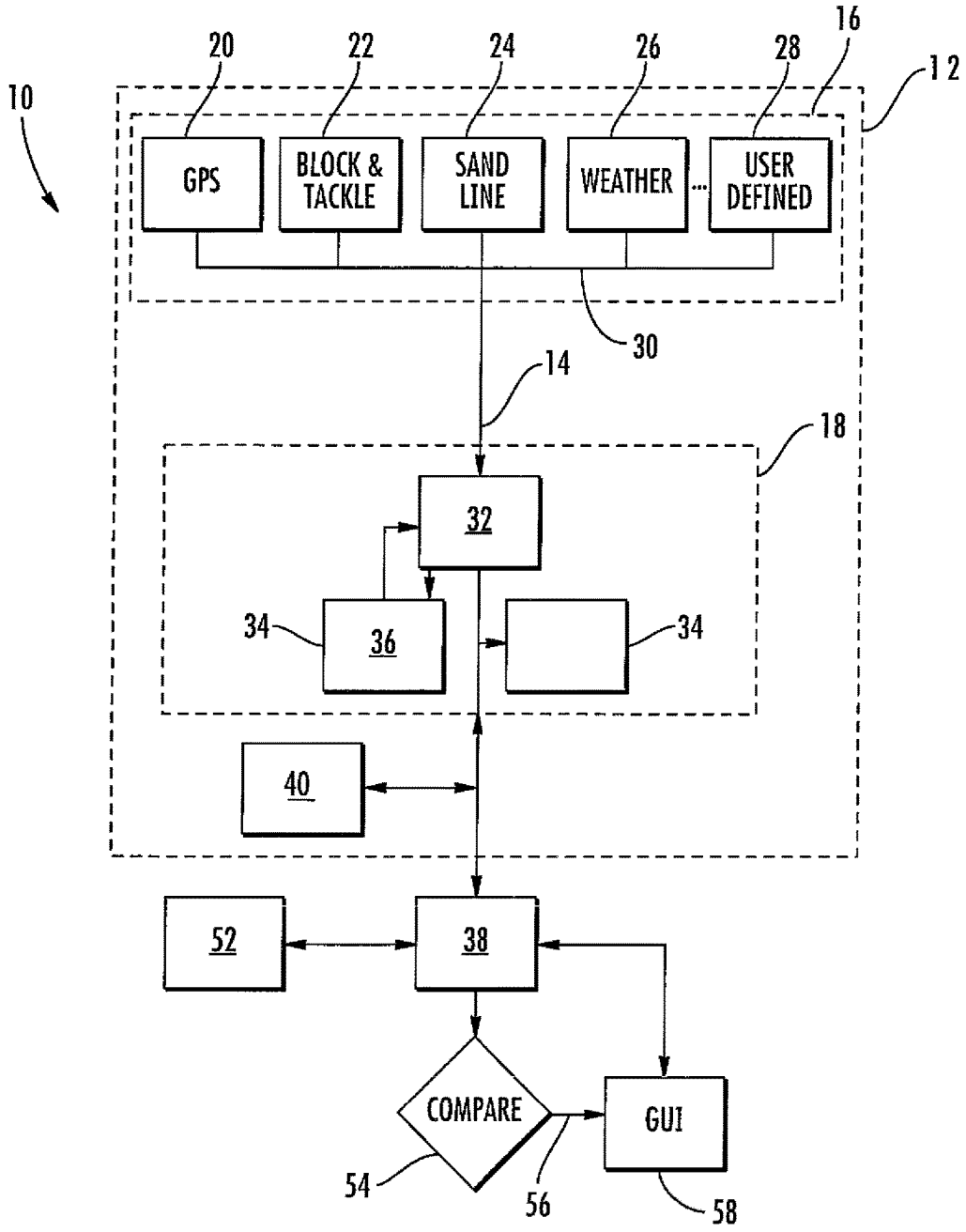
FIG. 1 is a block diagram of an exemplary system and method for communicating with a drill rig according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a system and method for communicating with a drill rig. The system generally includes one or more sensors that monitor conditions associated with the drill rig and generate data reflective of the conditions. The data may include, for example, temperature, pressure, speed, depth, weight, volume, or other operating parameters for various equipment on the drill rig. Alternately or in addition, the data may include environmental information associated with the drill rig, such as weather conditions, weather forecasts, location of the drill rig, and attitude (e.g., pitch and yaw) of the drill rig. The sensors transmit or otherwise communicate the data to a data acquisition board on the drill rig, and the data acquisition board formats the data for temporary storage. Periodically or continuously, the data acquisition board synchronizes the stored data with a portable communications device such as a smart phone or a tablet, and the portable communications device transmits the stored data to a database server remote from the drill rig. Alternately or in addition, the data acquisition board may transmit the stored data directly to the database server. The database server allows a customer to access the data. Alternately or in addition, the database server may compare the data to a predetermined baseline parameter or operating limit and notify the customer when the data approaches or exceeds one or more predetermined baseline parameters or operating limits. In this manner, the systems and methods described herein enable a customer to remotely communicate with the drill rig to receive real time or near real time data from the drill rig.

The present disclosure refers to sensors, processors, database servers, logic, memory, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, methods discussed herein may be implemented using a single server or multiple servers working in combination. Similarly, databases and logic for manipulating the databases may be implemented on a single system or distributed across multiple systems sequentially or in parallel. Data transferred between components may travel directly or indirectly. For example, if a first device accesses a file or data from a second device, the access may involve one or more intermediary devices, proxies, and the like. The actual file or data may move between the components, or one device may provide a pointer or metafile that the other device uses to access the actual data from a still further device.

The various computer systems discussed herein are not limited to any particular hardware architecture or configuration. Embodiments of the methods and systems set forth herein may be implemented by one or more general-purpose or customized computing devices adapted in any suitable manner to provide desired functionality. The device(s) may be adapted to provide additional functionality complementary or unrelated to the present subject matter, as well. For instance, one or more computing devices may be adapted to provide desired functionality by accessing logic or software instructions rendered in a computer-readable form. When software is used, any suitable programming, scripting, or other type of language or combinations of languages may be used to implement the teachings contained herein. However, software need not be used exclusively, or at all. For example, some embodiments of the systems and methods set forth herein may also be implemented by hard-wired logic or other circuitry, including, but not limited to application-specific circuits. Of course, combinations of computer-executed software and hard-wired logic or other circuitry may be suitable, as well.

Embodiments of the systems and methods disclosed herein may be executed by one or more suitable computing devices. Such system(s) may comprise one or more computing devices adapted to perform one or more embodiments of the methods disclosed herein. As noted above, such devices may access one or more computer-readable media that embody computer-readable instructions which, when executed by at least one computer, cause the computer(s) to implement one or more embodiments of the methods of the present subject matter. Additionally or alternately, the computing device(s) may comprise circuitry that renders the device(s) operative to implement one or more of the methods of the present subject matter. Furthermore, components of the presently-disclosed technology may be implemented using one or more computer-readable media. Any suitable computer-readable medium or media may be used to implement or practice the presently-disclosed subject matter, including, but not limited to, diskettes, drives, and other magnetic-based storage media, optical storage media, including disks (including CD-ROMs, DVD-ROMs, and variants thereof), flash, RAM, ROM, and other memory devices, and the like.

Referring now to the drawings, wherein identical numerals indicate the same elements throughout the figures, FIG. 1 provides a block diagram of an exemplary system and method 10 for communicating with a drill rig 12 according to one embodiment of the present invention. As shown in FIG. 1, the system and method 10 may include a communication link 14 that operably connects one or more sensors 16 to a data acquisition board 18 on the drill rig 12. The communications link 14 may include one or more wired, wireless, or other suitable communication links known to one of ordinary skill in the art for transferring data between components.

The sensors 16 monitor parameters associated with the drill rig 12, equipment on the drill rig 12, and/or the environment of and around the drill rig 12. Examples of suitable sensors 16 within the scope of the present invention include a GPS sensor 20, a block and tackle sensor 22, a sand line sensor 24, a weather sensor 26, and even a user-defined sensor 28. The user defined sensor 28 enables a customer to identify another sensor to transmit data to the data acquisition board 18. In addition, logic 36 on the data acquisition board 18 and/or database server 38 may enable the customer to define and/or modify the baseline parameter or operating limit for one or more of the sensors 16. Each sensor 16 may transmit a specific type of data 30 associated with the drill rig 12 through the communications link 14. The data 30 may thus include information related to rig safety, equipment maintenance requirements, rig operating parameters, and other data of interest to rig management personnel.

The data acquisition board 18 may be contained within a protective housing on the drill rig 12 to insulate the data acquisition board 18 from the environment. The degree and type of protection the housing provides is dictated by the environment in which the data acquisition board 18 is used (e.g., weather proof, hermetically sealed, etc.). The data acquisition board 18 generally includes a processor 32 and memory 34 for receiving the data 30 associated with the drill rig 12 from the sensors 16. The processor 32 is configured to execute logic 36 stored in the memory 34 that causes the processor 32 to perform various functions on the data 30. For example, execution of the logic 36 may cause the processor 32 to format and store the data 30 for later transfer to a database server 38 remote from the drill rig 12. In this manner the data acquisition board 18 may concatenate all of the data 30 from each sensor 16 by converting the data 30 to a desired format and size before transferring the data 30 to the database server 38 remote from the drill rig 12.

Figure 2:
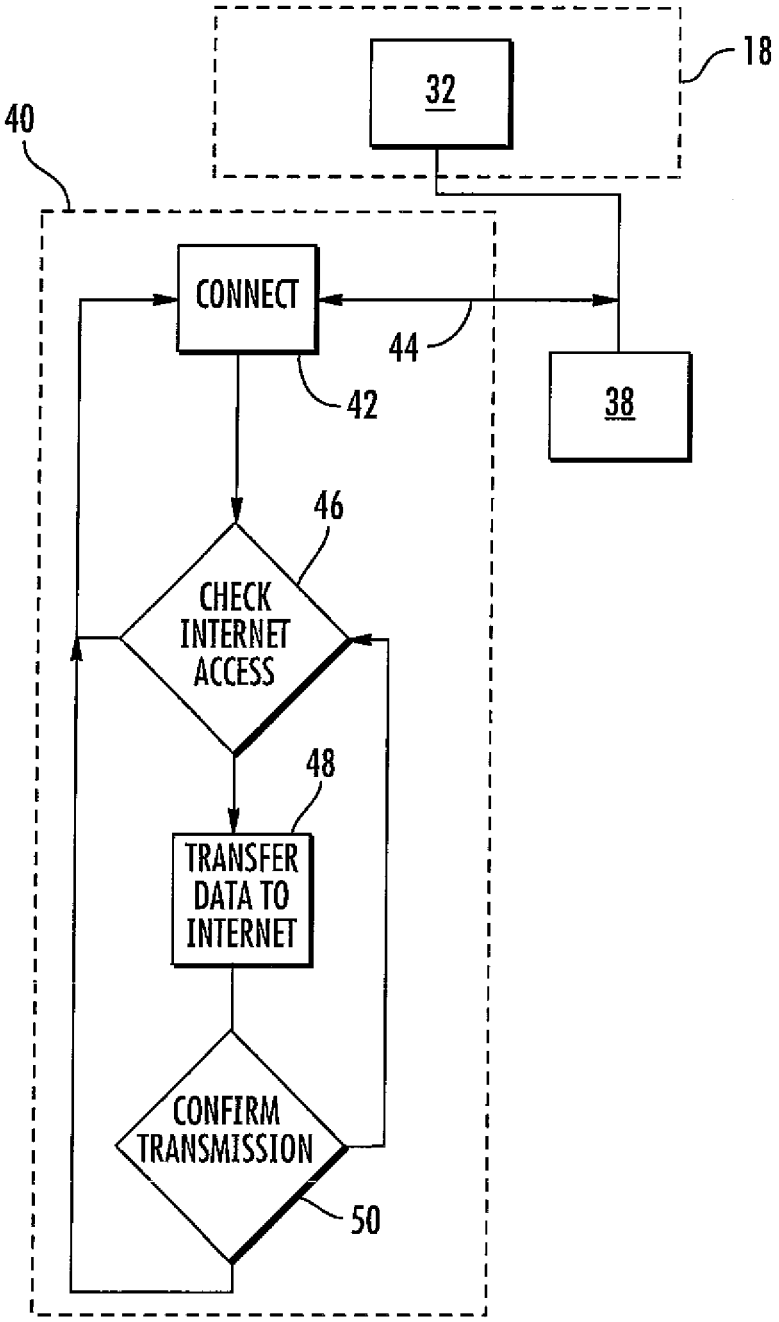
FIG. 2 is a block diagram of a communications protocol within the scope of various embodiments of the present invention.

Alternately or in addition, execution of the logic 36 may enable to the processor 32 to perform or participate in a communications protocol that enables the processor 32 to transfer the data 30 to a mobile communications device 40 such as a smart phone or tablet on the drill rig 12 for subsequent transfer to the database server 38 when communications are available. FIG. 2 provides a block diagram of an exemplary communications protocol within the scope of various embodiments of the present invention that may be incorporated into an application installed in the mobile communications device 40. At block 42, the mobile communications device 40 interfaces or connects to the processor 32 through a wired or wireless connection 44. This interface or connection may be at scheduled times or at predetermined intervals. For example, the mobile communications device 40 may initiate a Bluetooth® wireless connection to the data acquisition board 18 at 6 a.m., 12 p.m., 6 p.m., etc. or every 10 minutes since the last successful connection. Once communication with the data acquisition board 18 is established, the mobile communications device 40 and/or the processor 32 may identify the most recent data 30 transfer either to the database server 38 directly or to the mobile communications device 40, and the processor 32 may then transfer or synchronize all additional data 30 received from the sensors 16 and formatted since that time.

At block 46, the mobile communications device 40 may continuously or periodically check for internet access, and when internet access becomes available, the mobile communications device 40 may transfer all of the formatted data 30 through the internet to the database server 38, indicated by block 48. At block 50, the mobile communications device 40 may wait for confirmation that the data 30 transfer was complete. If the confirmation is received, the mobile communications device 40 returns to block 42 to wait for the next scheduled communication with the data acquisition board 18. Otherwise, the mobile communications device 40 returns to block 46 to check for internet access again.

Returning to FIG. 1, the database server 38 is configured to receive the formatted data 30 directly from the data acquisition board 18 or indirectly from the mobile communications device 40. The database server 38 may be, for example, a Redhat™ Linux server executing logic 52 to receive the formatted data 30 from multiple sources simultaneously, reconcile the data 30 to eliminate duplicate data 30, and/or convert the formatted data 30, as desired, to ASCII or another high level language for incorporation into a database. At block 54, the logic 52 may also cause the database server 38 to compare the data 30 to a predetermined limit and generate a notification 56 when one or more pieces of data 30 associated with a particular piece of equipment deviate from a baseline parameter or operating limit. The notification 56 may be assigned a priority level based on severity of the deviation from the baseline parameter or operating limit. For instance, a warning notification 56 may indicate that a relatively minor deviation from a baseline parameter or operating limit has occurred. In contrast, an alarm notification 56 may indicate that a significant deviation from a baseline parameter or operating limit has occurred.

Figure 3:
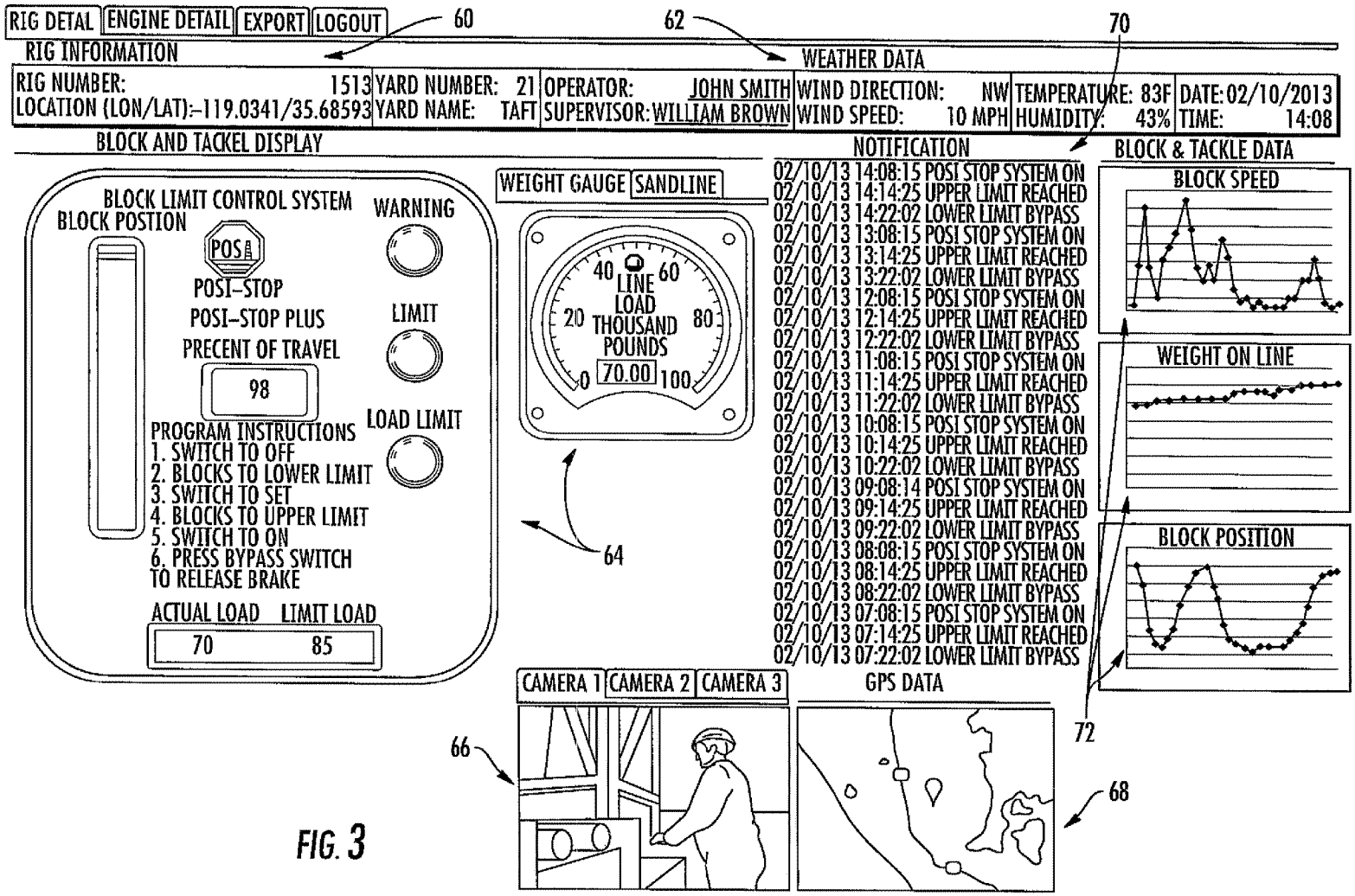
FIG. 3 is an exemplary screen shot showing data available to a customer.
Figure 4:
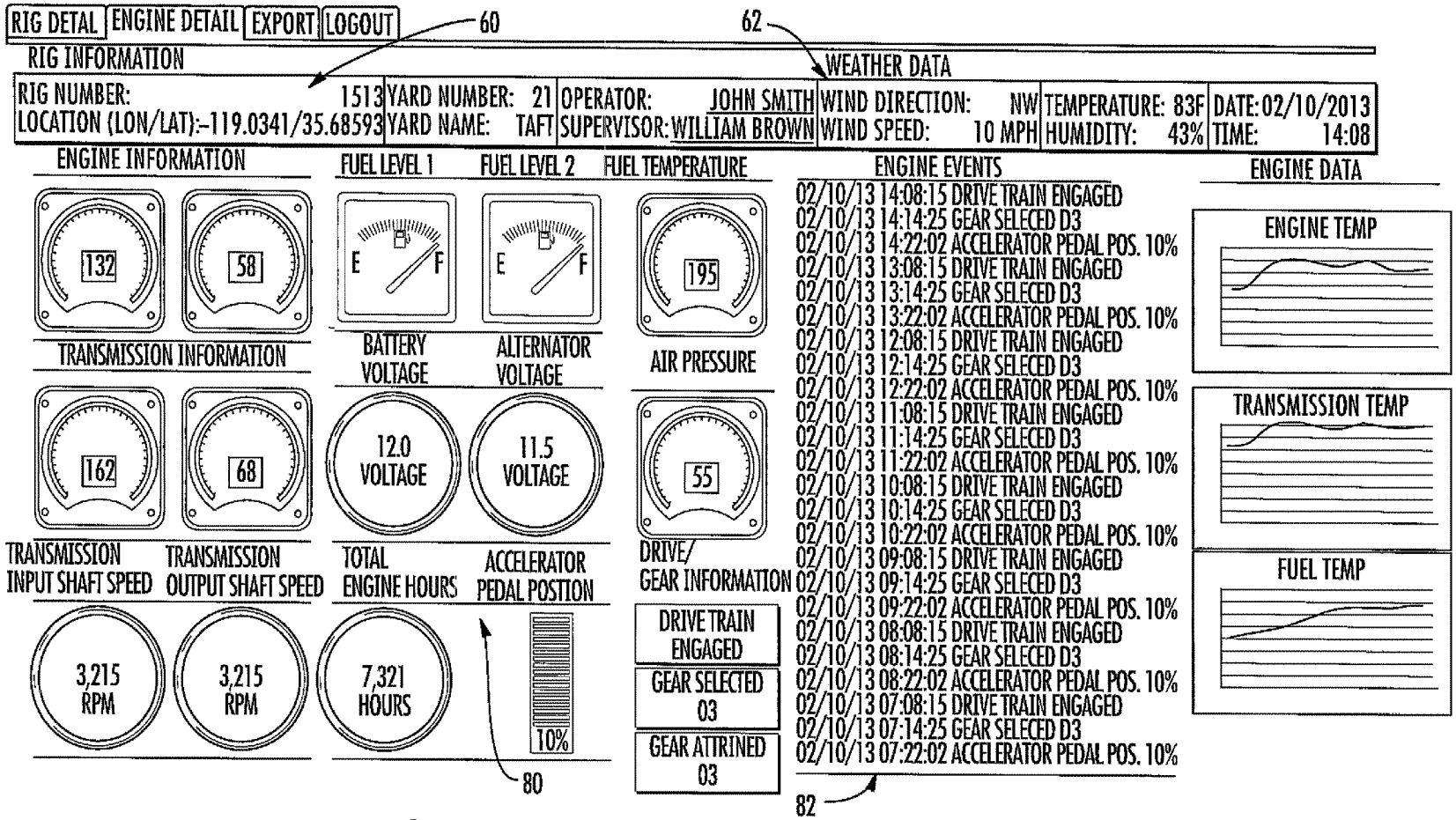
FIG. 4 is an exemplary screen shot showing data available to a customer.

As further shown in FIG. 1, the notifications 56 may be transmitted to a graphical user interface (GUI) 58 selected by a customer. The GUI 58 may be, for example, a smart phone, tablet, computer, or other communications device selected by the customer for receiving notifications 56 from the database server 38. In this manner, the customer may select the method (e.g., e-mail, text, dashboard alert, etc.) by which the customer may receive notifications 56 from the database server 38. Alternately or in addition, the GUI 58 may enable the customer to directly access data 30 and/or notifications 56 stored in the database server 38 for each drill rig 12 in the customer's account, and FIGS. 3 and 4 provide exemplary screen shots of the GUI 58 showing the data 30 available to the customer. As shown in FIG. 3, for example, the GUI 58 may display "RIG INFORMATION" 60 to identify the particular drill rig 12 and "WEATHER DATA" 62 local to that particular drill rig 12. In this exemplary screen shot, the GUI 58 may additionally display real time or near real time equipment readings 64, video streams 66, and/or GPS data 68. Alternately or in addition, the GUI 58 may display a record of previous notifications 70 and/or graphs of various selected operating parameters over time 72 to enable the customer to promptly respond to previous notifications 56 and/or anticipate and avoid future notifications 56.

As previously discussed with respect to FIG. 1, the logic 36 in the data acquisition board 18 may enable the customer to create one or more user-defined sensors 28 to monitor particular equipment and/or conditions on the drill rig 12. In addition, the logic 36 in the data acquisition board 18 and/or the logic 52 executed by the database server 38 may enable the customer to enable (i.e., turn on) a particular sensor 16 and/or adjust the baseline parameter or operating limit used to generate notifications 56. Referring to the screen shot shown in FIG. 4 , for example, the customer has enabled or selected several sensors 80—i.e., engine temperature, oil pressure, fuel levels, fuel temperature, transmission temperature and pressure, battery and alternator voltages, etc.—for the data acquisition board 18 to monitor and display on the GUI 58. In addition, the customer has adjusted or enabled various baseline parameters or operating limits 82 for one or more of the user-defined sensors 28 to generate desired notifications 56 that enhance the customer's real time or near real time monitoring of events and conditions on the drill rig 12.

The system and method 10 described and illustrated with respect to FIGS. 1-4 enhances a customer's ability to efficiently receive and analyze data 30 associated with a particular drill rig 12. For example, the system and method 10 of the present disclosure include the ability to provide real time or near real time updates from the drill rig 12 with no manual action by the customer, thereby enhancing on-time detection and diagnosis of anomalies. Alternately or in addition, the customer may configure different types of sensors 16, baseline parameters, and/or operating limits for each drill rig 12, depending on various factors specific to each drill rig 12, such as the prevailing issues, history, and/or personnel associated with each drill rig 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for communicating with an above ground drill rig, comprising:

a. a data acquisition board on the above ground drill rig;

b. a plurality of sensors on the above ground drill rig, wherein each sensor transmits data associated with the above ground drill rig to said data acquisition board, wherein said data comprises at least one of an operating parameter of equipment on the above ground drill rig or environmental information associated with the above ground drill rig;

c. a processor on said data acquisition board configured to execute first logic stored in a first memory that causes said processor to format said data, store said data, and transfer said data to a mobile communications device, wherein said mobile communications device comprises a smart phone or a tablet; and d. a database server remote from the above ground drill rig and in communication with the mobile communication device, wherein said database server is configured to recieve said data from the mobile communication device.

2. The system as in claim 1, wherein said database server is configured to execute second logic stored in a second memory that causes said database server to compare said data to a predetermined limit.

3. The system as in claim 2, wherein said database server is configured to generate a notification when said data exceeds said predetermined limit.

4. The system as in claim 2, wherein at least one of said first logic or said second logic enables a user to select said data to be transmitted by each sensor.

5. The system as in claim 2, wherein at least one of said first logic or said second logic enables a user to change said predetermined limit.

6. The system of claim 2, wherein at least one of said first logic or said second logic enables a user to enable an operating limit on the above ground drill rig.

7. A method for communicating with an above ground drill rig, comprising:

a. sensing an operating parameter of equipment on the above ground drill rig;

b. transmitting data reflective of said operating parameter to a data acquisition board on the above ground drill rig;

c. formatting said data with said data acquisition board;

d. transferring said formatted data from said data acquisition board to a mobile communications device, wherein said mobile communications device comprises a smart phone or a tablet, and e. transferring said formatted data from the mobile communication device to a database server remote from the above ground drill rig.

8. The method as in claim 7, further comprising selecting said operating parameter sensed on the above ground drill rig.

9. The system of claim 7, further comprising enabling an operating limit on the above ground drill rig.

10. The method as in claim 7, further comprising comparing said formatted data in said database server to a predetermined limit.

11. The method as in claim 10, further comprising generating a notification when said formatted data exceeds said predetermined limit.

12. The method as in claim 10, further comprising changing said predetermined limit.

13. A method for communicating with an above ground drill rig, comprising:

a. sensing an operating parameter of equipment on the above ground drill rig;

b. transmitting data reflective of said operating parameter to a data acquisition board on the above ground drill rig;

c. formatting said data with said data acquisition board;

d. transferring said formatted data parameter from said data acquisition board to a database server remote from the above ground drill rig; and e. enabling an operating limit on the above ground drill rig.

14. The method as in claim 13, further comprising selecting said operating parameter sensed on the above ground drill rig.

15. The method as in claim 13, further comprising comparing said formatted data in said database server to a predetermined limit.

16. The method as in claim 15, further comprising generating a notification when said formatted data exceeds said predetermined limit.

17. The method as in claim 15, further comprising changing said predetermined limit.

* * * * *